United States Patent [19]

Gilman et al.

[11] 3,979,538

[45] Sept. 7, 1976

[54] FLOCKED WEB AND METHOD OF PRODUCING SAME

[75] Inventors: Charles M. Gilman, Gilman; Bruce R. Borgersen, North Franklin; Lawrence M. Gilman, Gilman, all of Conn.

[73] Assignee: The Gilman Brothers Company, Gilman, Conn.

[22] Filed: Feb. 13, 1975

[21] Appl. No.: 549,467

[52] U.S. Cl. ..... 428/90; 427/244; 427/407; 428/198; 428/310; 428/311; 428/315

[51] Int. Cl.[2] ..... B32B 3/26

[58] Field of Search ..... 428/88, 90, 95, 198, 428/195, 196, 197, 310, 315, 311; 427/244, 407

[56] References Cited

UNITED STATES PATENTS

| | | | |
|---|---|---|---|
| 3,336,149 | 8/1967 | Fox et al. | 428/88 |
| 3,459,579 | 8/1969 | Newman | 428/90 |
| 3,607,341 | 9/1971 | Goins et al. | 428/315 |
| 3,713,868 | 1/1973 | Gordon et al. | 428/310 |
| 3,804,700 | 4/1974 | Hoey | 428/314 |
| 3,847,647 | 11/1974 | Bahlo | 428/198 |

*Primary Examiner*—William J. Van Balen
*Attorney, Agent, or Firm*—William R. Liberman

[57] ABSTRACT

A flocked fabric is produced by coating a knitted or woven fabric with an acrylic resin emulsion foam which is then partially dried and collapsed by squeezing. A self-cross-linking acrylic resin emulsion is screen printed as closely spaced dots on the coated fabric and polyester flock fibers having a flocking finish are deposited into the dot-carrying fabric while being oriented by an electrostatic field and the product is exposed to a hot air stream and high frequency dielectric field to dry and effect the cross-linking of the resin. The flock is produced by melt spinning pigment containing polyester and collecting them into bunches which are packaged on spools. The filament bundles are withdrawn from the spools and gathered into a tow which is cut by a fiber cutter to form the prefinished flock.

11 Claims, No Drawings

FLOCKED WEB AND METHOD OF PRODUCING SAME

BACKGROUND OF THE INVENTION

The present invention relates generally to improvements in the production of napped fabrics and it relates more particularly to an improved method of producing flocked webs and the resulting improved product.

In the manufacture of napped fabrics such as velvet, suede, plush, and the like, short fibers known as flock are deposited on an adhesive coated fabric or cloth while oriented in a direction perpendicular to the cloth under the influence of an electrostatic field, and the adhesive is thereafter set to anchor the flock in an upright position to the cloth. The flocked fabric produced by the conventional methods and those which have been heretofore proposed possess numerous drawbacks. They are stiff to the touch and generally have a very poor hand; they are not highly resistant to cleaning solvents and detergents; they are gas impervious and hence have no breathability, and they otherwise leave much to be desired. The known methods of producing flocked webs in addition to producing inferior products possess other disadvantages and have little versatility and adaptability.

SUMMARY OF THE INVENTION

It is a principal object of the present invention to provide an improved method for producing a napped web and the resulting improved product.

Another object of the present invention is to provide an improved method of applying and anchoring flock to a web substrate to produce an improved napped web of the nature of velvet, plush, suede, and the like.

Still another object of the present invention is to provide an improved method of producing a flocked cloth having high breathability and a superior hand.

A further object of the present invention is to provide a method of the above nature characterized by reliability, great versatility and adaptability, high efficincy, and the superiority and high quality of the end product.

The above and other objects of the present invention will become apparent from a reading of the following description which sets forth preferred embodiments thereof.

In a sense, the present invention contemplates the provision of an improved method for producing a flocked web comprising the steps of applying to a face of a web substrate closely spaced dots of an adhesive in an unset state, applying flock to the adhesive-carrying face, and thereafter effecting the setting of the adhesive. Another feature of the present invention resides in the use of a thermosetting or self-crosslinking resin emulsion as the adhesive and heating the adhesive following the application of the flock by exposing the flock-carrying web to a high frequency dielectric heating field to effect the crosslinking of the resin.

The flock may be formed of natural, artificial or synthetic fibers of suitable lengths and thicknesses and may be produced in a known manner, the flock produced from synthetic fibers advantageously having an electrically conducting or antistatic finish. For example, the flock may be produced by cutting a polyester filament tow having an electrically conducting flocking finish with a guillotine cutter to lengths of about 0.5 to a few millimeters and thicknesses of about ½ to 5 denier, depending on the desired end product. The substrate web is preferably a knitted or woven fabric and the adhesive a self-crosslinking acrylic resin emulsion. A polymeric resin emulsion foam precoat is advantageously applied to the fabric and after being partially dried the fabric is passed between squeeze rolls to collapse the foam to a highly porous state. The precoated fabric then traverses a screen printer wherein the adhesive-defining polymer resin emulsion is applied as closely spaced dots, the screens preferably being of a size of 20 to 60 mesh, a 30 mesh screen giving highly satisfactory results. The individual dots may be circular or of other configuration, the area of the individual dot being between 0.0005 and 0.0002 square inches, and the space between adjacent dots being between 0.001 and 0.005 square inches.

The adhesive screen printed cloth is transported under tensioned condition through one or more electrostatic flock applicators of known construction where the treated flock is applied in the desired density and properly oriented and adheres to the adhesive dots. The flocked cloth is then exposed to a flow of hot air to effect the drying of the adhesive emulsion and is thereafter subject to a high frequency electric field to effect the setting and crosslinking of the adhesive resin.

The improved process is highly reliable and efficient and of great versatility and adaptability and the resulting product is highly breathable and of soft and superior hand.

DESCRIPTION OF THE PREFERRED EMBODIMENT

The flock, according to the preferred embodiment of the present invention, is formed of polybutylene terephthalate or polyethylene terephthalate which is spun dyed in the preparation of the filaments. Specifically, the polyester resin and a suitable temperature-resistant dye or pigment dispersed in polyester resin are homogenously mixed in the resin molten state, and the molten resin is extruded through groups of spinnerettes countercurrent to cooling air at an input temperature of about 70°F., the filaments being gathered into bundles and having traversing a liquid finish applicator in which a spin finish containing a fatty acid derived catienic based liquid and an antistatic agent is applied to the polyester filaments. The filament bundles are drawn between differentially driven godet wheels having a speed ratio of 3 to 1, the trailing and leading godet wheel pairs are heated to 28°C. and 128°C. respectively, and the final filament denier is between 1 ½ and 3 denier. The stretched filament bundles are wound on individual spools, the spools being mounted on a creel from which the filament bundles are withdrawn and combined to form a tow which is fed through guillotine type reciprocating cutters which chop the tow into flock having lengths of about 0.035 inch. Other type cutters or grinders may be employed to produce flock of uniform or random lengths depending on the desired end product. The cut flock is then flash dried and screened to remove hard particles and oversized flock and then held for the flocking process.

The flocked cloth substrate is a woven or single knitted fabric of any desired width, for example, 48 inches wide, and is continuously advanced through the line of flocking equipment which includes a first coating device which may be of the doctor blade or knife coating type. In the first coating device, a 13 mils thick layer of acrylic latex foam having a density of 0.2 and the following composition is applied:

| | |
|---|---|
| E1082 acrylic emulsion (Rohm & Haas) | 300 pounds |
| PC-1/$H_2O$(50/50)(melamine slurry)(crosslinking agent) | 2816 mls |
| ASE60/$H_2O$(50/50)(ACRYSOL - Rohm & Haas)(thickener) | 2200 mls |
| Ammonium stearate (foam stabilizer) | 4285 mls |
| Ammonium hydroxide | amount to provide pH of 9 |

The foam-coated substrate is then dried at about 275°F. after which it is passed between squeeze rolls to crush and collapse the foam coating and effect its porosity.

The precoated substrate then traverses a screen printer in which there is employed a screen of about 9 mils thickness with an approximately 35 to 40 mesh opening or screen size. The printer uniformly deposits regularly closely spaced dots of liquid adhesive on the coated substrate which function is to anchor the flock to the substrate while affording free breathability to the end product and providing for a soft hand and high abrasion resistance and durability. The composition of the liquid adhesive is as follows:

| | |
|---|---|
| E-934 (self-crosslinking acrylic copolymer emulsion, Rohm & Haas) | 300 pounds |
| NOPCO DF-160L (Nopco Chemical Co. antifoaming agent) | 1433 mls |
| ASE 60/$H_2O$(50/50) | 1600 mls |
| Ammonium nitrate (30% solution)(crosslinking catalyst) | 6815 mls |
| Ammonium hydroxide | 1000 mls |

The adhesive printed substrate is conveyed by a vacuum blanket successively to one or more flock applying units of known construction and of the AC or DC fiber orienting electrostatic type and including beating bars (equipment manufactured by Indev, Inc.). Each flock applying unit is of the triple flocking module type and in each unit, through the application of the beater bars below the high voltage electrodes (average voltage about 30,000 volts), the polyester flocked fibers are uniformly scattered over the advancing substrate in a manner to cause the flock to stand vertical in the adhesive, the electrostatic field orienting the fibers perpendicular to the substrate and the beater bars driving the flock to penetrate the adhesive. Excess flock is removed by a suction device at the top and bottom. The substrate traverses two successive flocking units, and, with three denier polyester flock of lengths of 0.030 to 0.035 inches, the flock density is about 3.5 gms/ft$^2$ or 1.1 oz/yd$^2$.

The substrate, after leaving the flocking units, traverses a pair of successive ovens where it is exposed to high velocity air flows of about 3000 fpm, in the first oven at a temperature of about 250°–300°F. and in the second oven at about 350°F., the residence time in each oven being about 30 seconds. Following the hot air convection ovens, the flocked web advances thorugh an electrical high frequency dielectric heating oven operating at a frequency of 27 mHz. The web, as it advances through the high frequency oven, is supported by longitudinally spaced transversely extending rods or electrodes, the residence time of the substrate in the oven being about 10 seconds, the oven having an overall power of about 30 KW and drawing about 0.8 to 3 amperes.

The web, upon leaving the second convection drying oven, has a moisture content not exceeding 8%, which is substantially dry, and the high frequency oven functions to effect the curing or crosslinking of the substantially dry adhesive resin to convert it from a thermoplastic to a thermoset state by introducing covalent chemical crosslinking. As a consequence, in the end product the adhesive layer is insoluble and infuseable so that the flocked web is washable, dryable at high temperatures, and resistant to heat, melting, cleaning solvents, and strong detergents. The high frequency dielectric curing is advantageously performed at an elevated ambient temperature, for example, 280°F., and to this end the heated air is circulated between the second convection oven and the high frequency dielectric heating oven. The web leaving the high frequency oven is cooled by traversing water cooled drums or cans, and is then brushed and vacuumed to remove excess unanchored flock.

While there has been described a preferred embodiment of the present invention, it is apparent that numerous alterations, omissions and additions may be made without departing from the spirit thereof. For example, the screen size of the adhesive emulsion printer may be greater or less than that indicated, as small as 20 mesh or less, and as great as 60 mesh or more by industry standards.

We claim:

1. The method of producing a flocked web comprising the steps of applying to a face of a porous fabric substrate an acrylic emulsion foam, at least partially drying and collapsing said foam to form a pervious subcoat, applying to said subcoat closely spaced dots of an adhesive in an unset state, applying flock to said adhesive carrying face and thereafter effecting the setting of said adhesive.

2. The method of claim 1 wherein said adhesive dots are applied by screen printing.

3. The method of claim 2 wherein said adhesive comprises an emulsion of a polymeric resin.

4. The method of claim 2 wherein said adhesive comprises a self-crosslinking acrylic polymeric resin.

5. The method of claim 4 wherein said adhesive and flock carrying web are exposed to a high frequency electric field to effect the heating of said adhesive and the crosslinking of said resin.

6. The method of claim 5 wherein said adhesive and flock carrying web is convection heated prior to said exposure to said high frequency electric field.

7. The method of producing a flocked fabric comprising the steps of applying an acrylic resin emulsion foam precoat to said fabric, at least partially drying said precoat and squeezing said fabric to collapse said foam, applying a crosslinkable acrylic resin emulsion by screen printing in the form of closely spaced dots to said precoated fabric, applying a flock to said screen printed fabric, and thereafter effecting the drying of said emulsion and the crosslinking of said crosslinkable resin.

8. The method of claim 7 wherein said drying and crosslinking step includes exposing said flocked fabric to a high frequency electric field.

9. The method of claim 7 wherein said flocked fabric is exposed to a flock orienting electrostatic field during the application of said flock.

10. A flocked web comprising a porous cloth fabric substrate, a collapsed porous foam layer superimposed on and adherent to a face of said substrate, a plurality of closely spaced resin dots adherent to said foam layer, and flock fibers extending from and anchored to said dots.

11. The web of claim 10 wherein said dots are formed of a crosslinked acrylic resin, and said fibers are oriented in a direction perpendicular to the plane of said web.

* * * * *